US009456698B2

(12) United States Patent
Oh

(10) Patent No.: US 9,456,698 B2
(45) Date of Patent: Oct. 4, 2016

(54) FOLDABLE BED FRAME STRUCTURE WITH WHEELS

(71) Applicant: GRANTEC (XIAMEN) CO., LTD., Xiamen (CN)

(72) Inventor: Suk Kan Oh, Xiamen (CN)

(73) Assignee: GRANTEC (XIAMEN) CO., LTD., Xiamen, Fujian (CN)

( * ) Notice: Subject to any disclaimer, the term of this patent is extended or adjusted under 35 U.S.C. 154(b) by 0 days.

(21) Appl. No.: 14/664,937

(22) Filed: Mar. 23, 2015

(65) Prior Publication Data

US 2016/0206111 A1 Jul. 21, 2016

(30) Foreign Application Priority Data

Jan. 19, 2015 (CN) ..... 2015 2 0034546 U

(51) Int. Cl.

*A47C 19/12* (2006.01)
*A47C 19/00* (2006.01)
*A47C 19/02* (2006.01)

(52) U.S. Cl.

CPC ..... *A47C 19/122* (2013.01); *A47C 19/005* (2013.01); *A47C 19/02* (2013.01); *A47C 19/024* (2013.01)

(58) Field of Classification Search

CPC .. A47C 23/005; A47C 19/12; A47C 19/005; A47C 19/122; A47C 17/64; A47C 17/645; A47C 17/70; A47C 19/02; A47C 19/024

See application file for complete search history.

(56) References Cited

U.S. PATENT DOCUMENTS 65,222 A * 5/1867 Hoert ..... A47C 19/122 5/152
323,800 A * 8/1885 Fenton ..... A47C 19/122 5/152
807,909 A * 12/1905 Braznell ..... A47C 19/122 5/12.2
819,435 A * 5/1906 Jonas ..... A47C 19/122 5/152
1,474,200 A * 11/1923 McKellar ..... A47C 19/122 5/152
1,841,648 A * 1/1932 Sorey ..... A47C 19/122 5/152
2,823,391 A * 2/1958 Fischer ..... A47C 19/122 5/152
3,108,291 A * 10/1963 Eason ..... A47C 17/68 5/111
3,295,149 A * 1/1967 Hall ..... A47C 19/122 5/111

(Continued)

*Primary Examiner* — David E Sosnowski
*Assistant Examiner* — Eric Kurilla
(74) *Attorney, Agent, or Firm* — Leong C. Lei

(57) ABSTRACT

A foldable bed frame structure with wheels includes two frames and two side leg supports. Each frame includes two longitudinal poles and transverse poles connected between the longitudinal poles. The foldable bed frame structure further includes a middle leg support disposed between the frames for connecting the two frames. The middle leg support includes two U-shaped middle leg pipes, two top connecting poles, two bottom connecting poles, and at least two wheels disposed at the bottoms of the U-shaped middle leg pipes. The inner ends of the longitudinal poles of the frames are pivotally connected with two ends of each of the two top connecting poles of the middle leg support, respectively. The present invention is convenient for folding and moving.

5 Claims, 5 Drawing Sheets

(56) References Cited

U.S. PATENT DOCUMENTS 3,995,334 A * 12/1976 Harris ..... A47C 19/005 5/181
4,048,683 A * 9/1977 Chen ..... A47C 19/122 5/174
4,594,743 A * 6/1986 Owen ..... A47C 17/70 5/111
5,257,428 A * 11/1993 Carroll ..... A47C 19/122 5/201
5,579,550 A * 12/1996 Bathrick ..... A47C 19/005 5/184
6,035,468 A * 3/2000 Lee ..... A47C 17/645 5/112
7,493,667 B2 * 2/2009 Ferko, III ..... A61G 7/015 297/354.13
2004/0055085 A1 * 3/2004 Boscaro ..... A47C 19/122 5/110
2007/0226902 A1 * 10/2007 Lin ..... A47C 19/005 5/201
2013/0312185 A1 * 11/2013 Suh ..... A47C 19/122 5/618
2015/0320225 A1 * 11/2015 Boyd ..... A47C 19/04 5/202

* cited by examiner

FOLDABLE BED FRAME STRUCTURE WITH WHEELS

BACKGROUND OF THE INVENTION (a) Technical Field of the Invention

The present invention relates to a bed frame, and more particularly to a foldable bed frame structure with wheels.

(b) Description of the Prior Art

A foldable iron bed frame is convenient for use and saving storage space so it becomes a spare article in our daily life. A conventional foldable bed frame comprises a bed frame body and foldable leg supports to support the bed frame body. The bed frame body comprises at least two frame units which are pivotally connected. The bed frame body is composed of two longitudinal poles and at least three transverse poles which are a front pole, a middle pole, and a rear pole. Each longitudinal pole comprises at least two rods which are pivotally connected. The transverse pole located at the middle of the bed frame body is pivotally connected on the two rods. The left and right two rods, the transverse poles, and the middle transverse pole form the frame units. When the iron bed frame is folded, the two frame units are pivoted about the middle transverse pole to be folded together and the leg supports are folded to the lower surface of each frame unit to complete the folding of the entire bed frame.

The iron bed frame has the advantages of better rigidity and strong support, but it is heavy and inconvenient for moving. In particular, for women or the elderly with limited power, it will be affected by the weight and cannot be moved easily. Besides, it needs at least two persons to move the mattress placed on the bed frame. It is a waste of manpower and time-consuming.

Accordingly, the inventor of the present invention has devoted himself based on his many years of practical experiences to solve these problems.

SUMMARY OF THE INVENTION

The primary object of the present invention is to provide a foldable bed frame structure with wheels which is convenient for folding and moving.

In order to achieve the aforesaid object, the foldable bed frame structure with wheels comprises two frames in a bilateral arrangement, two side leg supports disposed at the bottoms of the outer ends of the frames. Each frame comprises two longitudinal poles at two sides thereof, and a plurality of transverse poles connected between the two longitudinal poles. The foldable bed frame structure further comprises a middle leg support disposed between the frames for connecting the two frames. The middle leg support comprises two U-shaped middle leg pipes each having two upright poles and a bottom transverse pole, two top connecting poles connected with the ends of the upright poles of the two U-shaped middle leg pipes, two bottom connecting poles connected with the bottom transverse poles of the two U-shaped middle leg pipes, and at least two wheels disposed at the bottoms of the U-shaped middle leg pipes. The inner ends of the longitudinal poles of the frames extend beyond the transverse poles. The inner ends of the longitudinal poles of the frames are pivotally connected with two ends of each of the two top connecting poles of the middle leg support, respectively.

Preferably, the middle portions of the two top connecting poles of the middle leg support are movably provided with an H-like connecting pipe. The H-like connecting pipe comprises two short poles. The two short poles of the H-like connecting pipe have elongate troughs for connecting the middle portions of the two top connecting poles. The short poles each have two ends to hold against the inner ends of the longitudinal poles of the two frames.

Preferably, the junctions of the longitudinal poles of the frames and the two top connecting poles of the middle leg support are provided with U-shaped connecting plates, respectively.

Preferably, the transverse poles of each frame are spaced and parallel with each other. The transverse poles are welded to the longitudinal poles to form the frame. The inner ends of the two frames are connected through the middle leg support. The outer end of each frame is provided with a curved pipe extending upward.

Preferably, at least one of the U-shaped connecting plates is moveably detachable through a wing nut cooperating with a bolt. The detachable U-shaped connecting plate is adapted to lock the two curved pipes of the two frames by means of the wing nut and the bolt after the frames are folded.

Preferably, each side leg support comprises two upright poles, a transverse pole, and two auxiliary support poles connected with the corresponding frame and the two upright poles. The upright poles are pivotally connected to the bottoms of two ends of the transverse pole located close to the outer end of the frame. The transverse pole of each side leg support is connected between the two upright poles of each side leg support to support the upright poles of each side leg support. The two auxiliary support poles each have one end pivotally connected to the outer side of the corresponding upright pole of each side leg support and another end pivotally connected to the corresponding longitudinal pole. Each auxiliary support pole comprises an inner pipe and an outer pipe. One end of the inner pipe is inserted into the outer pipe. Another end of the inner pipe is pivotally connected to the outer side of the corresponding upright pole of each side leg support. One end of the outer pipe is pivotally connected to the bottom of the corresponding longitudinal pole of the frames. Another end of the outer pipe is connected with the inner pipe through a pin.

Preferably, the wheels are universal wheels and comprise four wheels disposed at two ends of the bottom transverse pole of each U-shaped middle leg pipe, respectively.

Preferably, the wheels are universal wheels connected to the bottoms of the two bottom connecting poles connected with the bottom transverse poles of the two U-shaped middle leg pipes, respectively.

According to the aforesaid structure, the foldable bed frame with wheels of the present invention comprises the middle leg support disposed between the two frames and the universal wheels disposed at the bottom of the middle leg support. When the user wants to move the foldable bed frame structure with wheels of the present invention, the frames and the side leg supports are folded toward the middle leg support so that the frames and the side leg supports are supported by the middle leg support. By applying slight force to the middle leg support for the frames, the folded bed frame can be moved easily, and the direction of movement can be changed as desired. It is very convenient for use. The bed frame can be moved conveniently. In addition, the mattress can be folded and placed in the middle leg support to be carried together.

DETAILED DESCRIPTION OF THE PREFERRED EMBODIMENTS

Embodiments of the present invention will now be described, by way of example only, with reference to the accompanying drawings.

Figure 1:
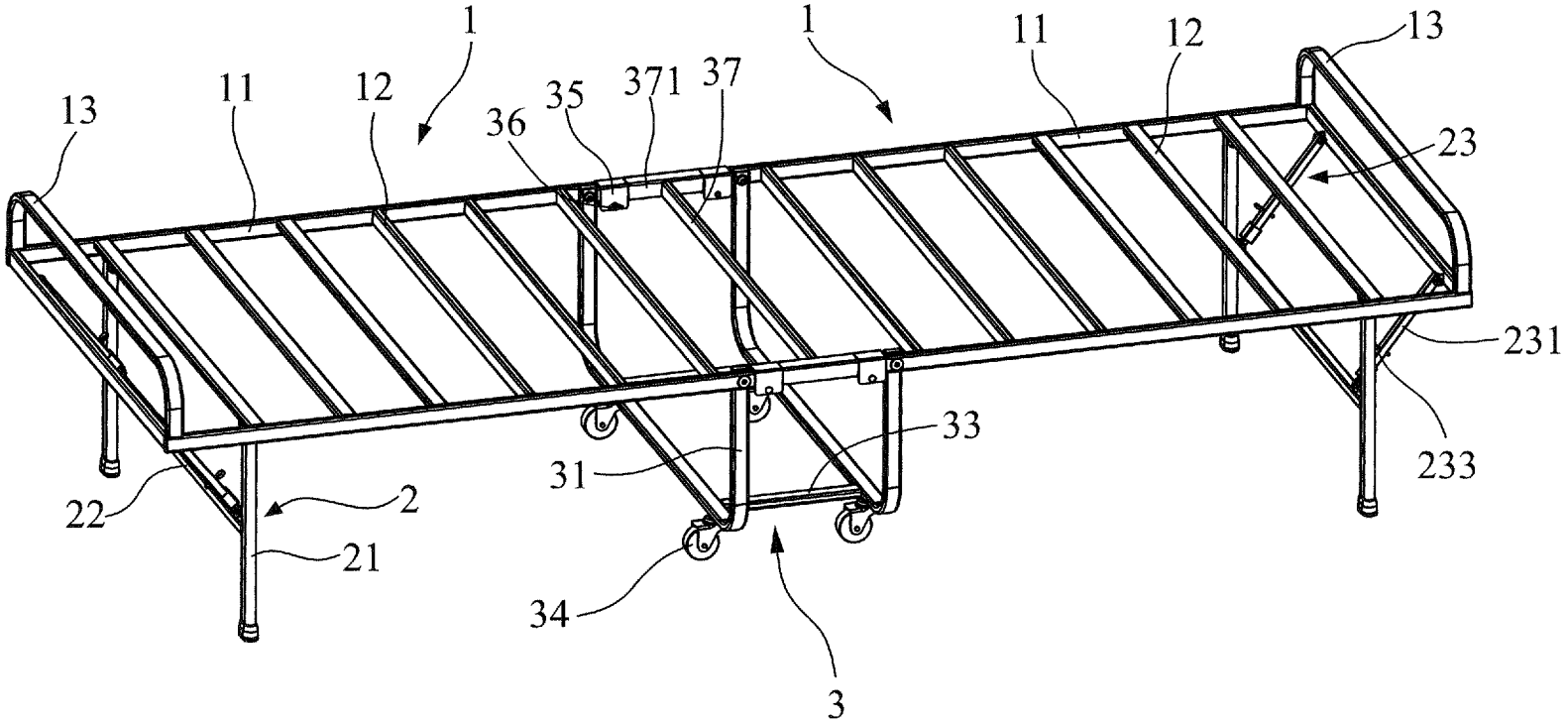
FIG. 1 is a perspective view of the present invention in an unfolded state.
Figure 2:
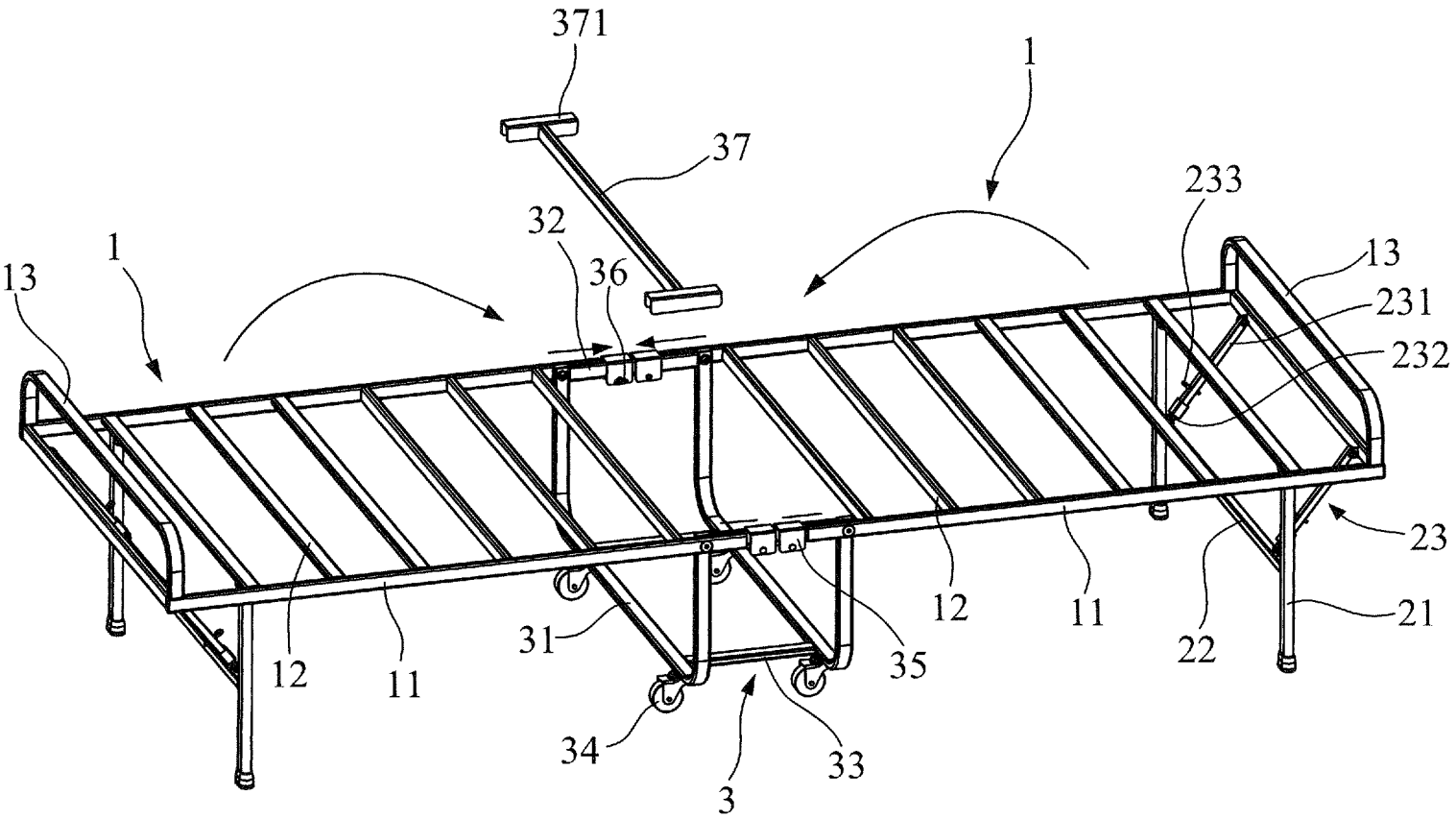
FIG. 2 is a first schematic view of the present invention when folded.
Figure 3:
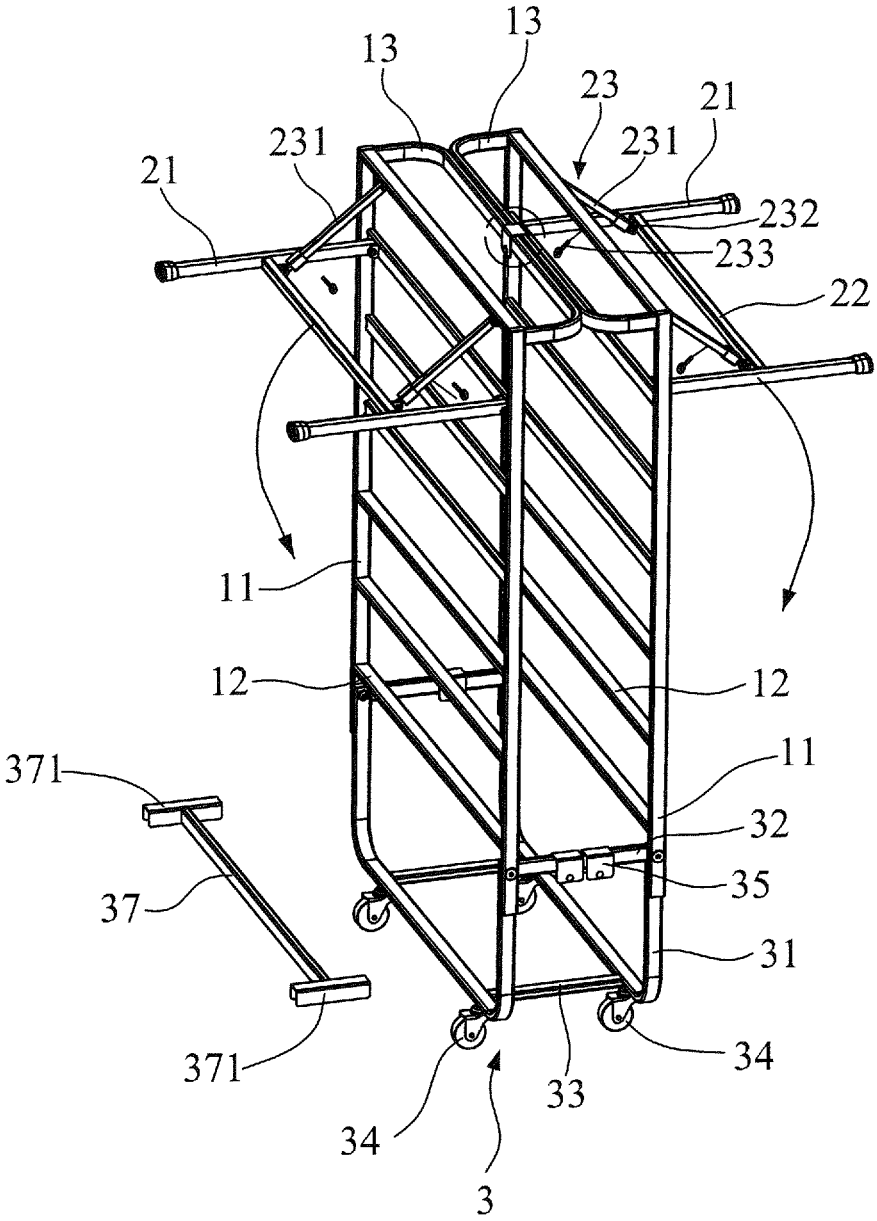
FIG. 3 is a second schematic view of the present invention when folded.
Figure 4:
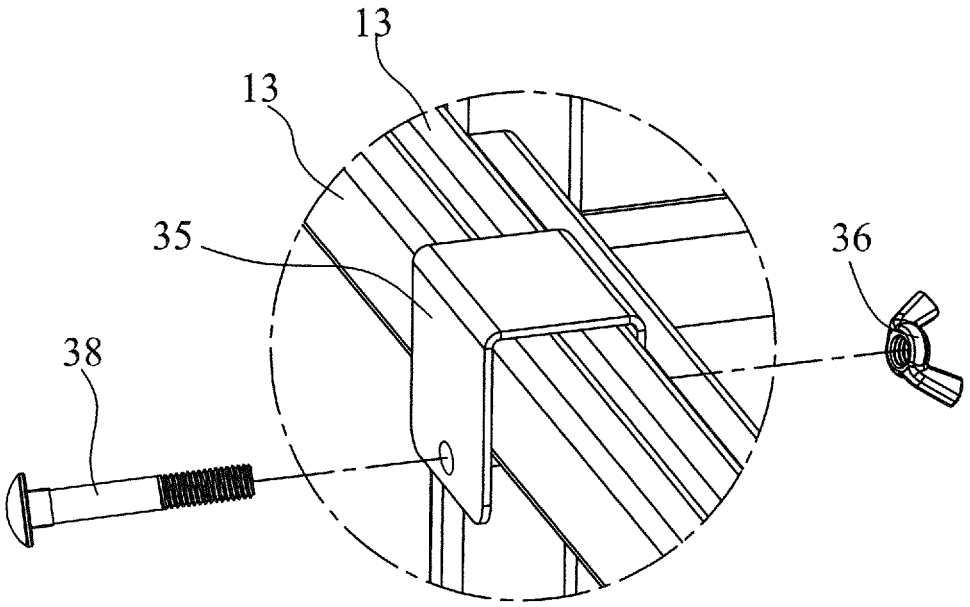
FIG. 4 is a partial enlarged view of FIG. 3.
Figure 5:
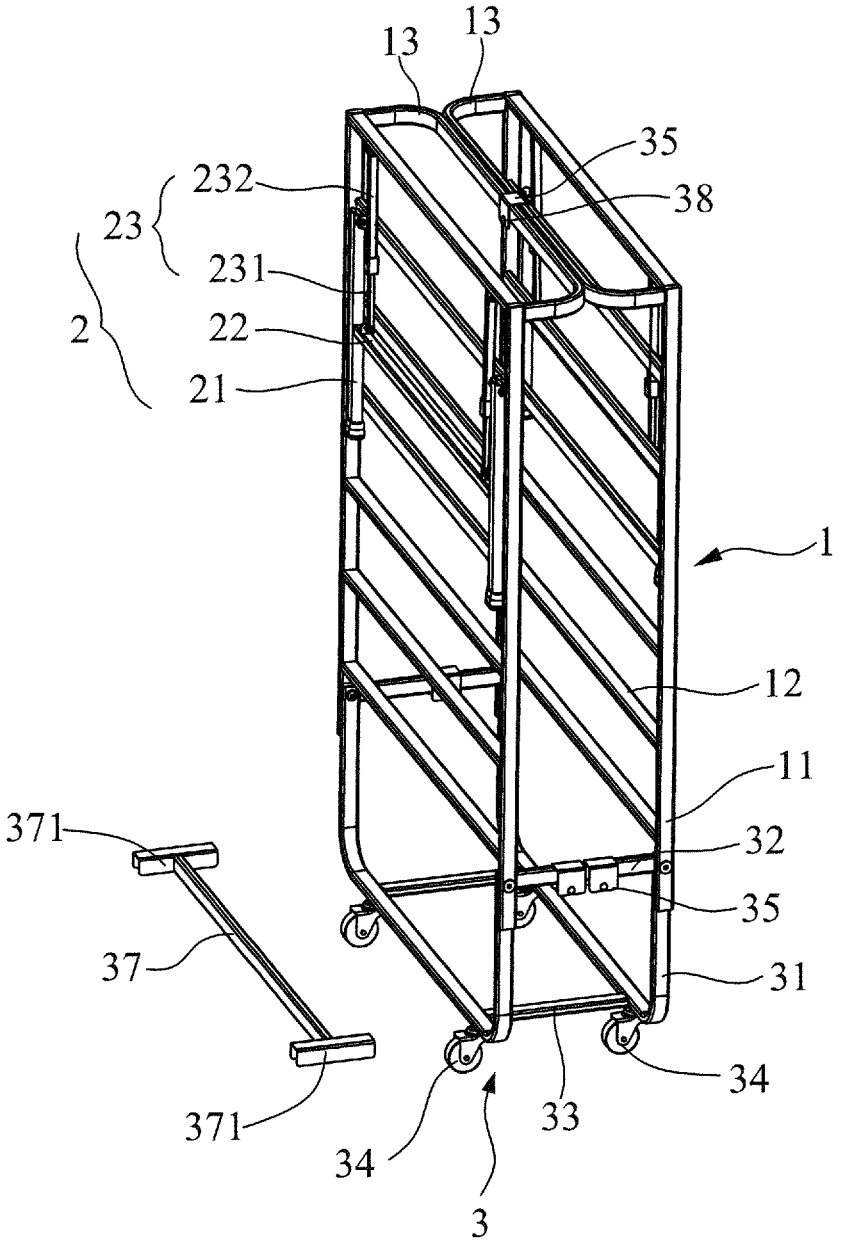
FIG. 5 is a perspective view of the present invention in a folded state.

As shown in FIG. 1, the present invention discloses a foldable bed frame structure with wheels. The foldable bed frame structure with wheels comprises two frames 1 in a bilateral arrangement, two side leg supports 2 disposed at the bottoms of the frames 1, and a middle leg support 3 disposed at the bottoms of the frames 1.

Each frame 1 comprises two longitudinal poles 11 at two sides thereof and a plurality of transverse poles 12. The transverse poles 12 are spaced and parallel with each other. The transverse poles 12 are welded to the longitudinal poles 11 to form the frame 1. An outer end of each frame 1 is provided with a curved pipe 13 extending upward. Inner ends of the two frames 1 are connected through the middle leg support 3. Inner ends of the longitudinal poles 11 of the frames 1 extend beyond the transverse poles 12.

Each side leg support 2 comprises two upright poles 21, a transverse pole 22, and two auxiliary support poles 23 connected with the frame 1 and the two upright poles 21. The upright poles 21 are pivotally connected to the bottoms of two ends of the transverse pole 12 located close to the outer end of the frame 1. The transverse pole 22 is connected between the two upright poles 21 to support the upright poles 21. The two auxiliary support poles 23 each have one end pivotally connected to an outer side of a respective one of the upright poles 21 and another end pivotally connected to the a respective one of the longitudinal poles 11. Each auxiliary support pole 23 comprises an inner pipe 231 and an outer pipe 232 which can be extended or retracted. One end of the inner pipe 231 is inserted into the outer pipe 232. Another end of the inner pipe 231 is pivotally connected to the outer side of the transverse pole 12. One end of the outer pipe 232 is pivotally connected to the transverse pole 22 of the frame 1. Another end of the outer pipe 232 is connected with the inner pipe 231 through a pin 233.

The middle leg support 3 comprises two U-shaped middle leg pipes 31 each having two upright poles 311 and a bottom transverse pole 312, two top connecting poles 32 connected with the ends of the upright poles 311 of the two U-shaped middle leg pipes 31, two bottom connecting poles 33 connected with the bottom transverse poles 312 of the two U-shaped middle leg pipes 31, and four universal wheels 34 disposed at two ends of the bottom transverse pole 312 of each U-shaped middle leg pipe 31. The middle leg support 3 is disposed between the two frames 1 and connected between the two frames 1. The inner ends of the longitudinal poles 11 of each frame 1, extending beyond the transverse poles 12, are pivotally connected with two ends of the two top connecting poles 32 of the middle leg support 3 and provided with U-shaped connecting plates 35, respectively. At least one of the four U-shaped connecting plates 35 is moveably detachable through a wing nut 36 cooperating with a bolt 38. The middle portions of the two top connecting poles 32 are connected through an H-like connecting pipe 37. The H-like connecting pipe 37 comprises two short poles 371 each having two ends to hold against the inner ends, fitted with the U-shaped connecting plates 35, of the four longitudinal poles 11 of the two frames 1 to limit the U-shaped connecting plates 35 to move on the top connecting poles 32. The two short poles 371 of the H-like connecting pipe 37 each have an elongate trough for connecting the top connecting poles 32.

As shown in FIG. 1, when the foldable bed frame structure with wheels of the present invention is unfolded, the upright poles 21 of each side leg support 2 are in an upright state, and the inner pipe 231 and the outer pipe 232 of each auxiliary support pole 23 are in a coupling state, and the coupling state is fixed by the pin 233. The H-like connecting pipe 37 of the middle leg support 3 is coupled to the middle portions of the top connecting poles 32. The H-like connecting pipe 37 is adapted to connect the two top connecting poles 32 and form a support for the bed surface. The longitudinal poles 11 of the frames 1 are pivotally connected to the top connecting poles 32, such that the bed frame is unfolded.

As shown in FIG. 2 to FIG. 5, when the foldable bed frame structure with wheels of the present invention is folded, the pin 233 to secure the inner pipe 231 and the outer pipe 232 of each auxiliary support pole 23 of the side leg support 2 is pulled out, so that the inner pipe 231 can be pulled out of the outer pipe 232 along with movement of the transverse pole 22. Besides, the H-like connecting pipe 37 can be taken out. The wing nut 36 is unscrewed to disengage from the bolt 38 to take out one of the four U-shaped connecting plates 35. The other U-shaped connecting plates 35 can be slid according to the realistic situation. Each frame 1 is pivoted about the top connecting poles 32 of the middle leg support 3 toward the top of the middle leg support 3. The curved pipes 13 at the ends of the frames 1 are aligned with each other. The U-shaped connecting plate 35 which has been taken out can be fitted on the two curved pipes 13 to lock the two curved pipes by means of the wing nut 36 and the bolt 38. After that, each upright pole 21 of the side leg supports 2 and the transverse pole 22 connected with the upright poles 21 are turned toward the frame 1 so that the bed frame is folded.

When the user wants to move the foldable bed frame structure with wheels of the present invention, he/she just pushes the folded bed frame. Because the middle leg support 3 is provided with the four universal wheels 34, the folded bed frame can be pushed easily by applying slight force and the direction of movement can be changed as desired. It is very convenient for use. The bed frame can be moved conveniently. In addition, the mattress can be folded and placed in the middle leg support 3 to be carried together.

Although particular embodiments of the present invention have been described in detail for purposes of illustration, various modifications and enhancements may be made without departing from the spirit and scope of the present invention. Accordingly, the present invention is not to be limited except as by the appended claims.

I claim:

1. A foldable bed frame structure with wheels, comprising two frames in a bilateral arrangement, two side leg supports disposed at bottoms of outer ends of the frames, each frame comprising two longitudinal poles at two sides thereof, and a plurality of transverse poles connected between the two longitudinal poles, characterized by: the foldable bed frame structure further comprising a middle leg support disposed between the frames for connecting the two frames, the middle leg support comprising two U-shaped middle leg pipes each having two upright poles and a bottom transverse pole, two top connecting poles connected with ends of the upright poles of the two U-shaped middle leg pipes, two bottom connecting poles connected with the bottom transverse poles of the two U-shaped middle leg pipes, and at least two wheels disposed at bottoms of the U-shaped middle leg pipes, inner ends of the longitudinal poles of the frames extending beyond the transverse poles, the inner ends of the longitudinal poles of the frames being pivotally connected with two ends of each of the two top connecting poles of the middle leg support, respectively;

wherein the junctions of the longitudinal poles of the frames and the two top connecting poles of the middle leg support are provided with U-shaped connecting plates, respectively; the transverse poles of each frame are spaced and parallel with each other, the transverse poles being welded to the longitudinal poles to form the frame, inner ends of the two frames being connected through the middle leg support, the outer end of each frame being provided with a curved pipe extending upward; at least one of the U-shaped connecting plates is moveably detachable through a wing nut cooperating with a bolt, the detachable U-shaped connecting plate being adapted to lock the two curved pipes of the two frames by means of the wing nut and the bolt after the frames are folded.

2. The foldable bed frame structure with wheels as claimed in claim 1, wherein middle portions of the two top connecting poles of the middle leg support are movably provided with an H-like connecting pipe, the H-like connecting pipe comprising two short poles, the two short poles of the H-like connecting pipe having elongate troughs for connecting the middle portions of the two top connecting poles, the short poles each having two ends to hold against the inner ends of the longitudinal poles of the two frames.

3. The foldable bed frame structure with wheels as claimed in claim 1, wherein each side leg support comprises two upright poles, a transverse pole, and two auxiliary support poles connected with the corresponding frame and the two upright poles of each side leg support, the upright poles of each side leg support being pivotally connected to bottoms of two ends of the transverse pole of each side leg support located close to the outer end of the frame, the transverse pole of each side leg support being connected between the two upright poles of each side leg support to support the upright poles of each side leg support, the two auxiliary support poles each having one end pivotally connected to an outer side of the corresponding upright pole of each side leg support and another end pivotally connected to the corresponding transverse pole of each side leg support, each auxiliary support pole comprising an inner pipe and an outer pipe, one end of the inner pipe being inserted into the outer pipe, another end of the inner pipe being pivotally connected to an outer side of the corresponding upright pole of each side leg support, one end of the outer pipe being pivotally connected to the bottom of the corresponding longitudinal pole of the frames, another end of the outer pipe being connected with the inner pipe through a pin.

4. The foldable bed frame structure with wheels as claimed in claim 1, wherein the wheels are disposed at two ends of the bottom transverse pole of each U-shaped middle leg pipe, respectively.

5. The foldable bed frame structure with wheels as claimed in claim 1, wherein the wheels are connected to bottoms of the two bottom connecting poles connected with the bottom transverse poles of the two U-shaped middle leg pipes, respectively.

* * * * *